US010921734B2

(12) United States Patent
Watanabe

(10) Patent No.: US 10,921,734 B2
(45) Date of Patent: Feb. 16, 2021

(54) IMAGE FORMING APPARATUS THAT DETERMINES WHETHER TO PERFORM RUNNING-IN OPERATION

(71) Applicant: KYOCERA Document Solutions Inc., Osaka (JP)

(72) Inventor: Masaru Watanabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/809,381

(22) Filed: Mar. 4, 2020

(65) Prior Publication Data

US 2020/0285172 A1 Sep. 10, 2020

(30) Foreign Application Priority Data

Mar. 8, 2019 (JP) ..... JP2019-042893

(51) Int. Cl.
*G03G 15/08* (2006.01)
*G03G 15/10* (2006.01)

(52) U.S. Cl.
CPC ..... *G03G 15/105* (2013.01); *G03G 15/0851* (2013.01); *G03G 15/0856* (2013.01)

(58) Field of Classification Search
CPC ..... G03G 15/0848; G03G 15/0849; G03G 15/0856; G03G 15/105; G03G 15/556
USPC ..... 399/27, 49, 53
See application file for complete search history.

(56) References Cited

U.S. PATENT DOCUMENTS 9,921,523 B1 * 3/2018 Terada ..... G03G 15/556
10,698,337 B2 * 6/2020 Shimizu et al. ... G03G 15/0848

FOREIGN PATENT DOCUMENTS

JP 2006243114 A 9/2006

* cited by examiner

*Primary Examiner* — William J Royer
(74) *Attorney, Agent, or Firm* — Studebaker & Brackett PC

(57) ABSTRACT

An image forming apparatus includes an image forming section, a controller, and storage. The storage stores therein a coverage rate of a past image specified by a past print job. The controller includes a determining section and a first calculating section. When a new print job is received, the determining section determines whether or not to perform a running-in operation by comparing a coverage rate of a new image specified by the new print job to the coverage rate of the past image stored in the storage. The first calculating section calculates an amount of toner to be supplied from a developing section to a photosensitive drum based on the coverage rate of the new image. The running-in operation is to supply the toner in the amount calculated by the first calculating section from the developing section to the photosensitive drum before the new image is formed on a sheet.

9 Claims, 5 Drawing Sheets

IMAGE FORMING APPARATUS THAT DETERMINES WHETHER TO PERFORM RUNNING-IN OPERATION

INCORPORATION BY REFERENCE

The present application claims priority under 35 U.S.C. § 119 to Japanese Patent Application No. 2019-042893, filed on Mar. 8, 2019. The contents of this application are incorporated herein by reference in their entirety.

BACKGROUND

The present disclosure relates to an image forming apparatus.

A certain image forming apparatus includes a developing section, a controller, and a charge amount detector. The developing section develops an electrostatic latent image on a photosensitive drum to form a toner image. The charge amount detector detects a toner charge amount. The controller causes forcible ejection of degraded toner from the developing section based on a detection result of the charge amount detector.

SUMMARY

An image forming apparatus according to an aspect of the present disclosure includes an image forming section, a controller, and storage. The image forming section forms an image on a sheet. The controller controls the image forming section. The image forming section includes a photosensitive drum and a developing section. An electrostatic latent image is formed on the photosensitive drum corresponding to the image. The developing section develops the electrostatic latent image with toner. The storage stores therein a coverage rate of a past image specified by a past print job. The controller includes a determining section and a first calculating section. When a new print job is received, the determining section determines whether or not to perform a running-in operation by comparing a coverage rate of a new image specified by the new print job to the coverage rate of the past image stored in the storage. The first calculating section calculates an amount of toner to be supplied from the developing section to the photosensitive drum based on the coverage rate of the new image. The running-in operation is to supply the toner in the amount calculated by the first calculating section from the developing section to the photosensitive drum before the new image is formed on the sheet.

DETAILED DESCRIPTION

First Embodiment

Figure 1:
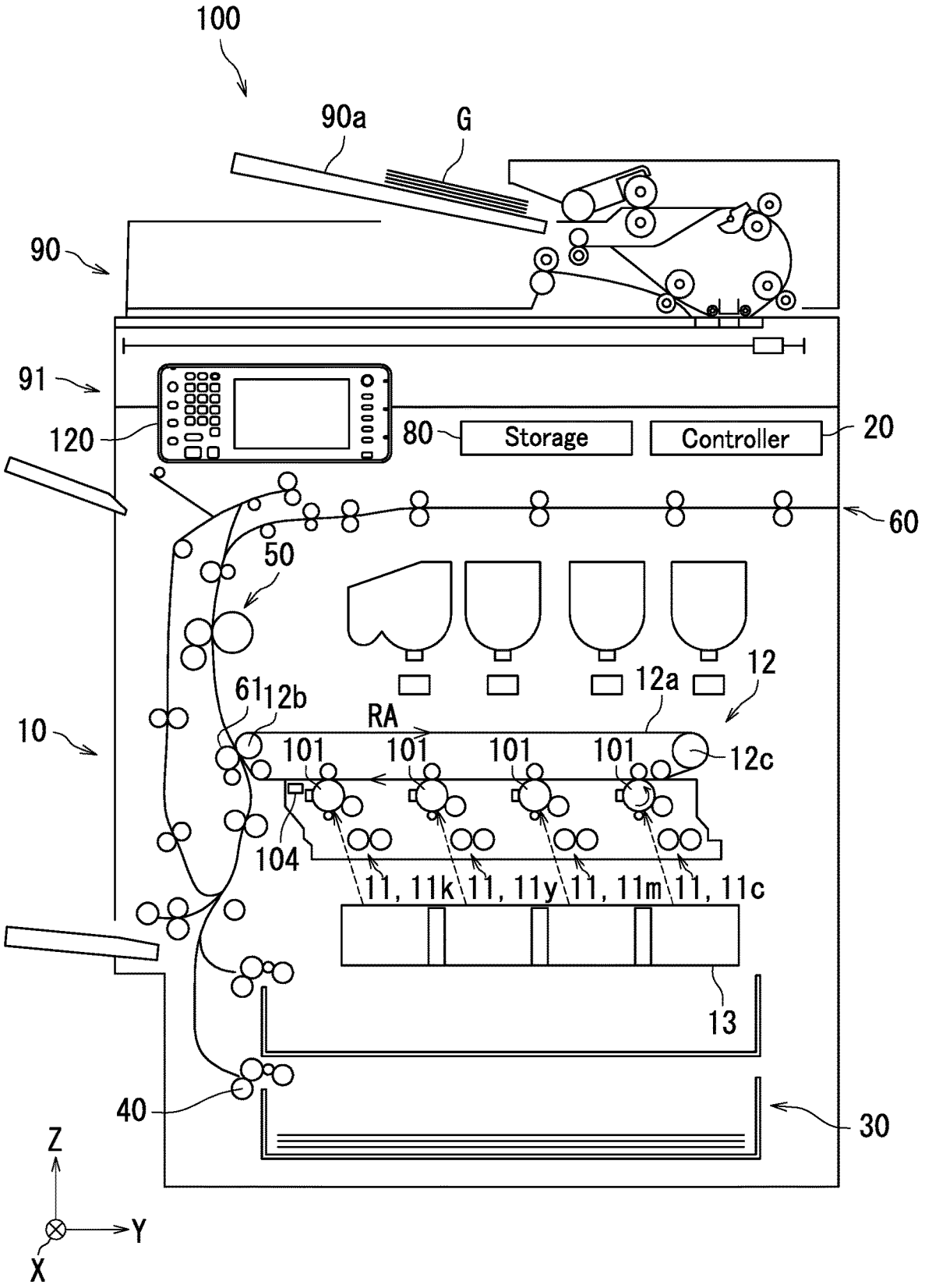
FIG. 1 is a diagram illustrating a configuration of an image forming apparatus according to an embodiment of the present disclosure.

The following describes embodiments of the present disclosure with reference to the accompanying drawings. Elements that are the same or equivalent are labeled with the same reference signs in the drawings and description thereof is not repeated. In the embodiments, X and Y axes run in horizontal directions, a Z axis runs in a vertical direction, and the X, Y, and Z axes are orthogonal to each other.

First, a configuration of an image forming apparatus 100 according to a first embodiment is described with reference to FIG. 1. FIG. 1 is a diagram illustrating the configuration of the image forming apparatus 100. The image forming apparatus 100 is a color multifunction peripheral, for example.

As illustrated in FIG. 1, the image forming apparatus 100 includes an image formation unit 10, a feed section 30, a conveyance section 40, a fixing section 50, an ejection section 60, a controller 20, storage 80, an operation section 120, a document feed section 90, a scanner 91, and a density sensor 104.

The document feed section 90 includes a document loading section 90*a*. The document feed section 90 conveys a document G set on the document loading section 90*a* to a reading position of the scanner 91.

The scanner 91 reads an image from the document G by irradiating the document G with light using an exposure lamp and receiving reflected light using a charge-coupled device (CCD) to generate image data indicating the image. The image data includes pixel data indicating a plurality of gradation values, for example. The scanner 91 then outputs the image data to the controller 20.

The feed section 30 feeds a sheet P to the conveyance section 40. The conveyance section 40 conveys the sheet P to the ejection section 60 by way of the image formation unit 10 and the fixing section 50. Examples of the sheet P include plain paper, copy paper, recycled paper, thin paper, thick paper, glossy paper, and an overhead projector (OHP) sheet.

The image formation unit 10 forms an image on the sheet P based on image data. The fixing section 50 applies heat and pressure to the sheet P to fix a toner image transferred to the sheet P to the sheet P. The ejection section 60 ejects the sheet P out of the image forming apparatus 100.

The controller 20 controls the image formation unit 10, the feed section 30, the conveyance section 40, the fixing section 50, the ejection section 60, the document feed section 90, the scanner 91, and the density sensor 104. Specifically, the controller 20 includes a processor such as a central processing unit (CPU).

The storage 80 includes a storage device and stores a computer program therein. Specifically, the storage 80 includes a main storage device such as semiconductor memory and an auxiliary storage device including for example either or both of semiconductor memory and a hard disk drive.

The operation section 120 includes a display section and an operation key section. The display section is a liquid-crystal display, for example. The display section displays image information. The display section also functions as a touch panel for input.

Next, the configuration of the image formation unit 10 is described. The image formation unit 10 includes a plurality of image forming sections 11, an exposure section 13, and a transfer section 12. That is, there are multiple image forming sections 11.

Toners of different colors are supplied to the respective image forming sections 11. The toners include a large number of toner particles. Each of the image forming sections 11 includes a photosensitive drum 101. For example, the image forming sections 11 include an image forming section 11*c* to which a cyan toner is supplied, an image forming section 11*m* to which a magenta toner is supplied, an image forming section 11*y* to which a yellow toner is supplied, and an image forming section 11*k* to which a black toner is supplied. Configurations of the image forming section 11*c*, the image forming section 11*m*, the image forming section fly, and the image forming section 11*k* are substantially identical.

The exposure section 13 irradiates each of the photosensitive drums 101 with laser light. As a result, an electrostatic latent image is formed on each of the photosensitive drums 101. The image forming sections 11 then develop the respective electrostatic latent images. The electrostatic latent images are developed with the respective different color toners. As a result, toner images of different colors are formed on the respective photosensitive drums 101.

The transfer section 12 includes an intermediate transfer belt 12*a*, a drive roller 12*b*, and a driven roller 12*c*. The intermediate transfer belt 12*a* is stretched around the drive roller 12*b* and the driven roller 12*c*. The intermediate transfer belt 12*a* is rotationally driven in a rotational direction RA by the drive roller 12*b*. The image forming sections 11 transfer the different colored toner images onto the intermediate transfer belt 12*a*. By superimposing the colored toner images on the intermediate transfer belt 12*a*, a toner image (specifically, a color image) is formed on the intermediate transfer belt 12*a*. The transfer section 12 transfers the toner image formed on the intermediate transfer belt 12*a* to the sheet P.

The density sensor 104 is positioned downstream of the photosensitive drums 101 in a conveyance direction of the sheet P. The density sensor 104 detects a density of the toner image formed on the intermediate transfer belt 12*a*. An example of the toner image is a patch image for calculating a toner charge amount in calibration of the toner charge amount. The density of the toner image indicates the mass of the toner forming the toner image per unit of surface area. Therefore, the density of the toner image is calculated based on the thickness of the toner image. In the first embodiment, the density sensor 104 detects a thickness HT of the toner image. In detail, the density sensor 104 measures a distance LT from the toner image to detect the thickness HT of the toner image. In further detail, the density sensor 104 detects the thickness HT of the toner image using the following equation (1).

$$(\text{Thickness } HT) = (\text{Reference distance } LTA) - (\text{Distance } LT) \quad (1)$$

The reference distance LTA indicates a distance between the density sensor 104 and the surface of the intermediate transfer belt 12*a*.

An example of the density sensor 104 is a laser displacement sensor. The laser displacement sensor includes a semiconductor laser and a linear image sensor, and measures the distance LT using triangulation. The density sensor 104 then outputs a detection signal SG1 indicating the density of the toner image to the controller 20.

Figure 2:
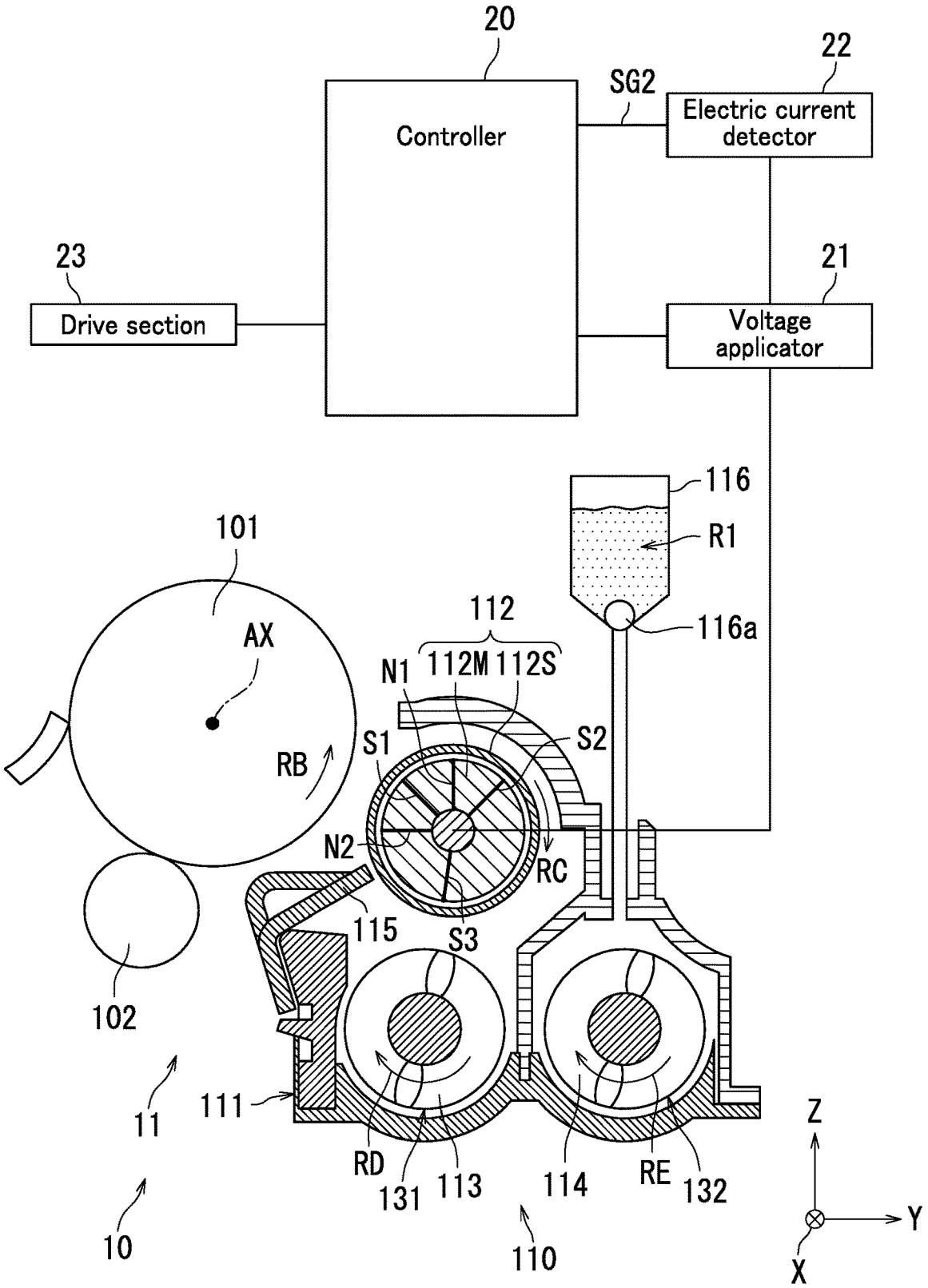
FIG. 2 is a cross-sectional view of an example of the configuration of an image forming section according to the embodiment.

Next, a configuration of an image forming section 11 according to the present embodiment is described with reference to FIG. 2. FIG. 2 is a cross-sectional view of an example of the configuration of the image forming section 11.

As illustrated in FIG. 2, each image forming section 11 further includes a developing section 110, a charger 102, a cleaner 103, and a toner container 116 in addition to a photosensitive drum 101. The photosensitive drum 101 is substantially columnar or cylindrical. The photosensitive drum 101 rotates in a rotational direction RB around a rotational axis AX of the photosensitive drum 101. Examples of the photosensitive drum 101 include an amorphous silicon (α-Si) photosensitive drum and an organic photoconductor (OPC) drum.

The charger 102 charges the entire surface of the photosensitive drum 101 to a prescribed potential. The charger 102 includes a charging roller, for example. As illustrated in FIG. 1, the exposure section 13 exposes a prescribed area of the surface of the photosensitive drum 101. As a result, an electrostatic latent image is formed in the prescribed area of the surface of the photosensitive drum 101.

Furthermore, the developing section 110 develops the electrostatic latent image formed in the prescribed area of the surface of the photosensitive drum 101 with toner particles to form a toner image in the prescribed area of the surface of the photosensitive drum 101. The toner particles are included in a two-component developer.

Specifically, the two-component developer includes a plurality of carrier particles (specifically a large number of carrier particles) in addition to the toner particles (specifically a large number of toner particles). The toner particles and the carrier particles are powders. The toner particles are positively chargeable toner particles, for example. The positively chargeable toner particles are charged positively through friction with the carrier particles.

The particle size of each toner particle is between 5.0 μm and 8.0 μm in volume median diameter ($D_{50}$) for example, and preferably between 5.2 μm and 6.7 μm.

The carrier particles are magnetic. The carrier particles are resin-coated carrier particles, for example. Core particles of the resin-coated carrier particles are made from ferrite or magnetite, for example. The particle size of each carrier particle is between 20 μm and 100 μm in mean volume diameter for example, preferably between 25 μm and 80 μm.

Here, a development nip part is formed between a development roller 112 and the photosensitive drum 101. Upon application of a development bias to the development roller 112, an electric field is formed around the development nip part. Accordingly, the toner particles are moved from the developing section 110 to the photosensitive drum 101 due to the effect of the electric field. As a result, the electrostatic latent image is visualized by the toner particles to be a toner image. The toner image is transferred to the intermediate transfer belt 12*a* illustrated in FIG. 1.

The developing section 110 includes a development housing 111, the development roller 112, a first screw feeder 113, a second screw feeder 114, and a regulating blade 115.

The development roller 112 is substantially columnar or cylindrical. The development roller 112 is positioned opposite to the photosensitive drum 101. The development roller 112 includes a sleeve 112S and a magnet 112M. The magnet 112M is positioned inside of the sleeve 112S. The magnet 112M includes an S1 pole, an N1 pole, an S2 pole, an N2 pole, and an S3 pole. The N1 pole functions as a main pole, the S1 pole and the N2 pole function as conveyance poles, and the S2 pole functions as a detachment pole. The S3 pole functions as a drawing pole and a regulation pole.

The sleeve 112S is a non-magnetic cylinder (an aluminum pipe, for example). The sleeve 112S is driven for example by a motor, and rotates in a rotational direction RC around the magnet 112M.

Accordingly, the sleeve 112S attracts the carrier particles with the magnetic force of the magnet 112M while rotating in the rotational direction RC. As a result, the carrier particles form a magnetic brush on the surface of the development roller 112. Specifically, a plurality of bristles of the magnetic brush is formed on the surface of the development roller 112. Each bristle of the magnetic brush is made from a plurality of carrier particles. That is, each bristle of the magnetic brush is a carrier particle cluster standing from the surface of the development roller 112. The toner particles are carried on the surfaces of the carrier particles. That is, the toner particles are carried on the surface of the development roller 112 while being carried by the magnetic brush.

The regulating blade 115 is positioned opposite to the development roller 112 with a prescribed space therebetween. The regulating blade 115 regulates the length of the bristles of the magnetic brush formed on the surface of the development roller 112.

The development housing 111 includes a conveyance section which houses the two-component developer. For example, the conveyance section includes a first conveyance section 131 and a second conveyance section 132. In the first conveyance section 131, the two-component developer is conveyed in a first conveyance direction from one end to the other end of the development roller 112 in an axial direction thereof. The second conveyance section 132 communicates with the first conveyance section 131 at both of the ends of the development roller 112 in the axial direction thereof. In the second conveyance section 132, the two-component developer is conveyed in a second conveyance direction which is opposite to the first conveyance direction.

Specifically, the second conveyance section 132 includes the second screw feeder 114. The second screw feeder 114 rotates in a rotational direction RE to convey the two-component developer in the second conveyance direction. The first conveyance section 131 includes the first screw feeder 113. The first screw feeder 113 rotates in a rotational direction RD to convey the two-component developer in the first conveyance direction. The first screw feeder 113 conveys the two-component developer in the first conveyance direction to supply the two-component developer to the development roller 112.

The toner particles included in the two-component developer are, for example, triboelectrically charged through friction with the carrier particles included in the two-component developer while being cyclically conveyed in the first conveyance direction and the second conveyance direction.

The toner container 116 has a housing section R1 which houses toner particles for replenishment use. The toner particles for replenishment use are replenished from the housing section R1 of the toner container 116 to the second conveyance section 132 of the developing section 110. The toner container 116 includes a replenishment amount adjusting member 116*a*. The replenishment amount adjusting member 116*a* adjusts the replenishment amount of the toner. The replenishment amount of the toner is an amount of the toner replenished from the toner container 116 to the second conveyance section 132. The replenishment amount adjusting member 116*a*, for example, includes a screw shaft for which the controller 20 controls a rotation operation.

The image forming section 11 further includes a drive section 23, a voltage applicator 21, and an electric current detector 22.

The drive section 23 rotationally drives the photosensitive drum 101, the development roller 112, the first screw feeder 113, the second screw feeder 114, and the replenishment amount adjusting member 116*a*. The drive section 23 has a motor and a gear mechanism, for example.

The voltage applicator 21 applies a development bias to the development roller 112. The development bias is a voltage in which an alternating current voltage is superimposed on a direct current voltage. The alternating current voltage is a square wave with a duty cycle of 50%, for example. Specifically, the voltage applicator 21 has a direct current power source and an alternating current power source. As a result, the development bias potential of the surface of the development roller 112 is a potential Vdc.

The charger 102 charges the surface of the photosensitive drum 101 to a prescribed potential V0 (V). The potential difference between a potential VL and the potential Vdc is a potential difference which moves charged toner particles from the development roller 112 to the electrostatic latent image. Specifically, the toner particles carried on the development roller 112 are electrically attracted and fly toward the electrostatic latent image on the photosensitive drum 101. As a result, a toner image is formed on the electrostatic latent image of the photosensitive drum 101.

The electric current detector 22 detects the electric current value of the electric current flowing between the photosensitive drum 101 and the development roller 112. The electric current detector 22 then outputs a detection signal SG2 to the controller 20. The detection signal SG2 indicates the electric current value of the electric current flowing between the photosensitive drum 101 and the development roller 112.

Figure 3:
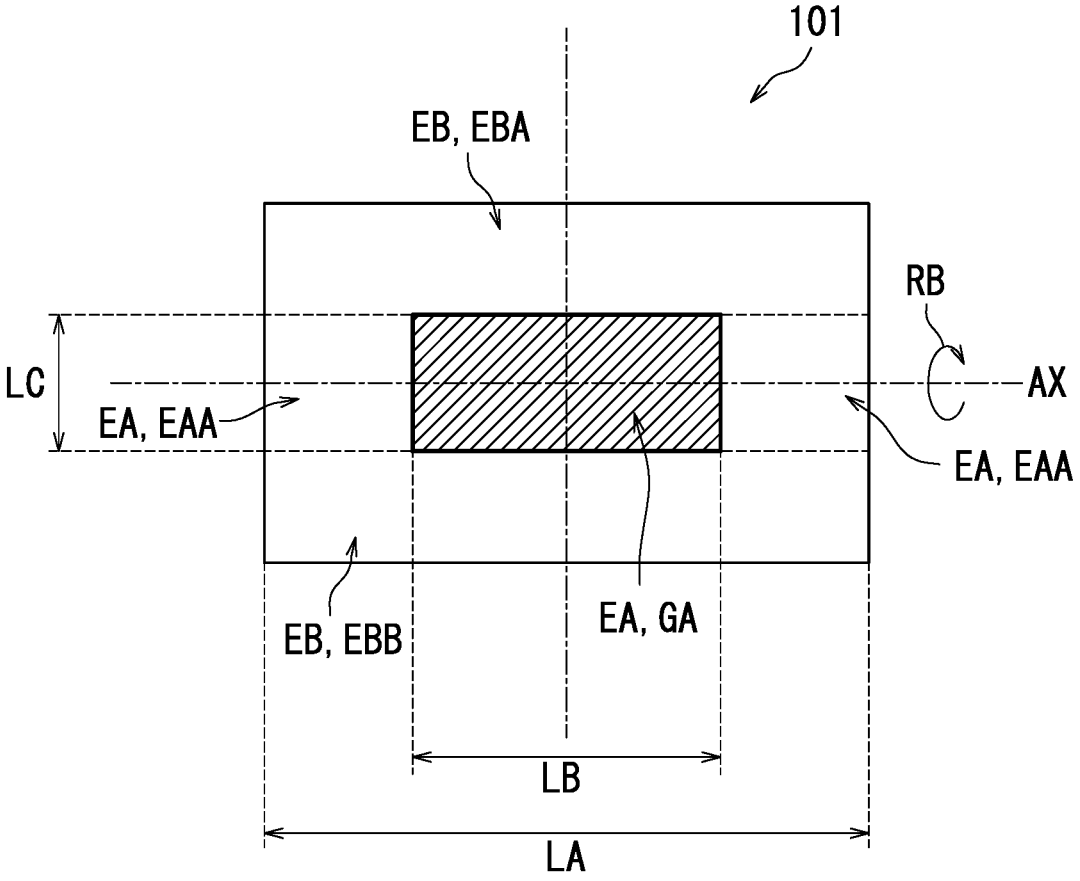
FIG. 3 is a plan view of an example of a configuration of a photosensitive drum with an electrostatic latent image formed thereon according to the embodiments.

Next, a configuration of a photosensitive drum 101 with an electrostatic latent image GA formed thereon is described with reference to FIG. 3. FIG. 3 is a plan view of an example of the configuration of the photosensitive drum 101 with the electrostatic latent image GA formed thereon. In FIG. 3, the photosensitive drum 101 is viewed from a direction orthogonal to the rotational axis AX of the photosensitive drum 101. In the following, a view of the photosensitive drum 101 from the direction orthogonal to the rotational axis AX may be referred to as a "plan view".

As illustrated in FIG. 3, the length of the surface of the photosensitive drum 101 in the axial direction thereof is a first length LA.

The surface of the photosensitive drum 101 has a first area EA and a plurality of second areas EB. The second areas EB include a second area EBA and a second area EBB.

The second area EBA is positioned, in the circumferential direction of the photosensitive drum 101, upstream of the first area EA in the rotational direction RB of the photosensitive drum 101. The second area EBB is also positioned, in the circumferential direction of the photosensitive drum 101, downstream of the first area EA in the rotational direction RB of the photosensitive drum 101.

The first area EA includes the electrostatic latent image GA, a partial blank paper portion EAA, and a partial blank paper portion EAB. The electrostatic latent image GA has a second length LB in the axial direction of the photosensitive drum 101. The electrostatic latent image GA has a third length LC in the circumferential direction of the photosensitive drum 101.

The electrostatic latent image GA is formed in a prescribed area within the first area EA. The exposure section 13 illustrated in FIG. 1, for example, includes a light source, a polygon mirror, a reflecting mirror, and a deflecting mirror. In detail, after being charged to the prescribed potential V0 (V) by the charger 102, the exposure section 13 irradiates the prescribed area with laser light having a prescribed strength or light quantity. Thus, the electrostatic latent image GA is formed on the surface of the photosensitive drum 101, and the potential of the electrostatic latent image GA changes from the potential V0 to the potential VL (V).

Figure 4:
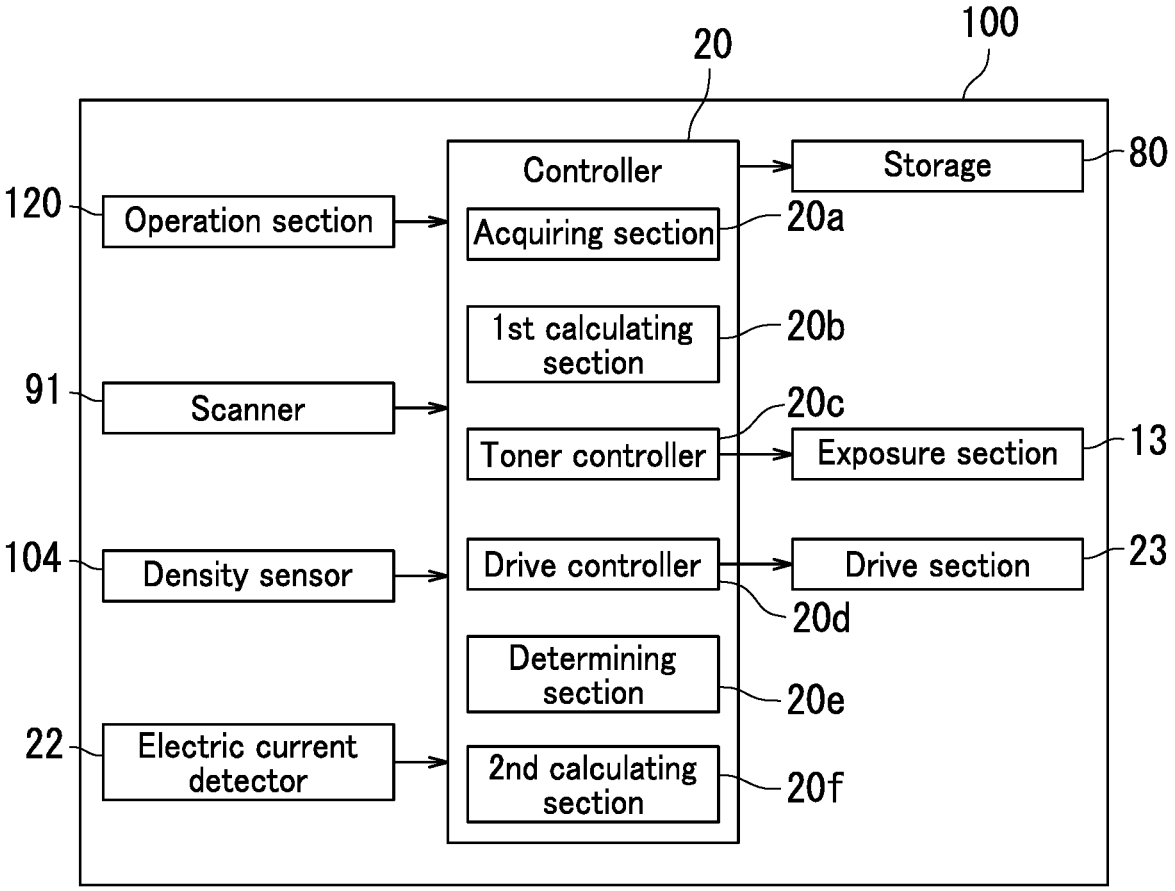
FIG. 4 is a block diagram illustrating a configuration of an image forming apparatus according to the embodiment.

The configuration of the image forming apparatus 100 according to the present embodiment is described with reference to FIG. 4. FIG. 4 is a block diagram illustrating the configuration of the image forming apparatus 100. As illustrated in FIG. 4, the controller 20 includes an acquiring section 20*a*, a first calculating section 20*b*, a toner controller 20*c*, a drive controller 20*d*, and a determining section 20*e*. The processor of the controller 20 functions as the acquiring section 20*a*, the first calculating section 20*b*, the toner controller 20*c*, the drive controller 20*d*, and the determining section 20*e* by executing a computer program stored in the storage device of the storage 80.

The acquiring section 20*a* acquires image data. For example, the acquiring section 20*a* receives image data from the scanner 91 when a new print job is received from the operation section 120. The print job indicates an instruction to form an image on a sheet P. Note that the acquiring section 20*a* may receive image data from an external device.

The first calculating section 20*b* calculates an amount of toner to be supplied from a developing section 110 to a photosensitive drum 101 based on the coverage rate of the image. In detail, the first calculating section 20*b* calculates the coverage rate of the image and the amount of toner based on the image data. Accordingly, the coverage rate of the image can be more accurately calculated. As a result, the amount of toner can be more accurately calculated.

When the image data includes information indicating a color image in which a plurality of color images are superimposed, the first calculating section 20*b* calculates an amount CSc of cyan toner, an amount CSm of magenta toner, an amount CSy of yellow toner, and an amount CSk of black toner.

In detail, the first calculating section 20*b* calculates CMYK values for pixel data of each of a plurality of pixels included in the image data. The first calculating section 20*b* calculates a total of the gradation values for each color in all of the pixel data. Specifically, the first calculating section 20*b* calculates a total value SMc of the cyan gradation values in all of the pixel data. The first calculating section 20*b* calculates a total value SMm of the magenta gradation values in all of the pixel data. The first calculating section 20*b* calculates a total value SMy of the yellow gradation values in all of the pixel data. The first calculating section 20*b* calculates a total value SMk of the black gradation values in all of the pixel data.

The first calculating section 20*b* calculates the amount CSc of cyan toner from the total value SMc based on a table or formula indicating the relationship between the total value SMc and the amount CSc of cyan toner. In the same manner, the first calculating section 20*b* calculates the amount CSm of magenta toner from the total value SMm, the amount CSy of yellow toner from the total value SMy, and the amount CSk of black toner from the total value SMk.

The toner controller 20*c* controls each of the image forming sections 11 so as to supply toner in the amount calculated by the first calculating section 20*b* from the developing section 110 to the photosensitive drum 101 in formation of an image on a sheet P. In detail, the toner controller 20*c* performs control so that an electrostatic latent image corresponding to the image is formed on the photosensitive drum 101 while the sheet P is conveyed in formation of the image on the sheet P.

Specifically, the toner controller 20*c* controls formation of an electrostatic latent image corresponding to a cyan image on the photosensitive drum 101 of the image forming section 11*c*. As a result, the amount CSc of cyan toner is supplied from the developing section 110 to the photosensitive drum 101 after passing through the developing section 110 under triboelectric charging. The toner controller 20*c* controls formation of an electrostatic latent image corresponding to a magenta image on the photosensitive drum 101 of the image forming section 11*m*. As a result, the amount CSm of the magenta toner is supplied from the developing section 110 to the photosensitive drum 101 after passing through the developing section 110 under triboelectric charging. The toner controller 20*c* controls formation of an electrostatic latent image corresponding to a yellow image on the photosensitive drum 101 of the image forming section 11*y*. As a result, the amount CSy of the yellow toner is supplied from the developing section 110 to the photosensitive drum 101 after passing through the developing section 110 under triboelectric charging. The toner controller 20*c* controls formation of an electrostatic latent image corresponding to a black image on the photosensitive drum 101 of the image forming section 11*k*. As a result, the amount CSk of the black toner is supplied from the developing section 110 to the photosensitive drum 101 after passing through the developing section 110 under triboelectric charging.

The storage 80 stores therein the coverage rate of a past image. When an image is formed on a sheet P based on image data, the first calculating section 20*b* stores the coverage rate of the image along with a date in the storage 80 as the coverage rate of a past image.

When a new print job is received, the determining section 20*e* determines whether or not to perform a running-in operation by comparing the coverage rate of a new image specified by the new print job to the coverage rate of the past image stored in the storage 80. The running-in operation is to supply toner in the amount calculated by the first calculating section 20*b* from a developing section 110 to a photosensitive drum 101 before the new image is formed on a sheet P. That is, the running-in operation means running-in operation (aging) through which the state of the toner when an image is formed on a sheet P is equalized with the state of the toner before the image is formed on the sheet P without conveying the sheet P. The coverage rate of the past image is preferably the coverage rate of an image formed on a sheet P directly before an image is formed on the sheet P according to the new print job.

Therefore, according to the first embodiment, when the difference between the coverage rate of the new image and the coverage rate of the past image is small, an image is formed on a sheet P without performing the running-in operation because the state in which the toner passes through the developing section 110 when the image is formed on the sheet P is equal to the state in which the toner passes through the developing section 110 directly before the image is formed on the sheet P. By contrast, when the difference between the coverage rate of the new image and the coverage rate of the past image is large, the running-in operation is performed. As a result, the state in which the toner passes through the developing section 110 when the image is formed on the sheet P and the state in which the toner passes through the developing section 110 directly before the image is formed on the sheet P, which have been different, are equalized by the running-in operation. Thus, the toner charge amount when the image is formed on the sheet P and the toner charge amount directly before the image is formed on the sheet P are equalized to each other. Accordingly, an image can be formed on a sheet P with a high-precision image density.

Based on the determination result of the determining section 20*e*, the toner controller 20*c* controls each image forming section 11 so as to supply toner in the amount calculated by the first calculating section 20*b* from the developing section 110 to the photosensitive drum 101 as the running-in operation before an image is formed on a sheet P.

In detail, the toner controller 20*c* causes the running-in operation to be performed when the difference between the coverage rate of the new image and the coverage rate of the past image is equal to or greater than a threshold. Specifically, a running-in operation is performed in the image forming section 11*c* when the difference between the coverage rate of a new cyan image and the coverage rate of a past cyan image is equal to or greater than a threshold. A running-in operation is performed in the image forming section 11*m* when the difference between the coverage rate of a new magenta image and the coverage rate of a past magenta image is equal to or greater than a threshold. A running-in operation is performed in the image forming section 11*y* when the difference between the coverage rate of a new yellow image and the coverage rate of a past yellow image is equal to or greater than a threshold. A running-in operation is performed in the image forming section 11*k* when a difference between the coverage rate of a new black image and the coverage rate of a past black image is equal to or greater than a threshold.

Specifically, the toner controller 20*c* causes formation of electrostatic latent images on the respective photosensitive drums 101 with sizes corresponding to the amounts of toner calculated by the first calculating section 20*b* and causes supply of toners in the amounts calculated by the first calculating section 20*b* from the developing sections 110 to the respective photosensitive drums 101. Therefore, according to the first embodiment, toners in the amounts of calculated by the first calculating section 20*b* can be easily supplied by adjusting the sizes of the respective electrostatic latent images.

In detail, the toner controller 20*c* causes formation of an electrostatic latent image on each photosensitive drum 101 with the second length LB in the axial direction of the photosensitive drum 101 and causes supply of toner in the amount calculated by the first calculating section 20*b* from a corresponding one of the developing sections 110 to the photosensitive drum 101. The second length LB corresponds to the amount of toner calculated by the first calculating section 20*b*.

The toner controller 20*c* performs formation of an electrostatic latent image on each photosensitive drum 101 with the third length LC in the circumferential direction of the photosensitive drum 101 and supply of toner in the amount calculated by the first calculating section 20*b* from a corresponding one of the developing sections 110 to the photosensitive drum 101 within a period. The third length LC corresponds to the period for which toner in the amount calculated by the first calculating section 20*b* is supplied.

The determining section 20*e* determines the period for which the running-in operation is performed based on the difference between the coverage rate of the new image and the coverage rate of the past image. Specifically, the period increases as the difference grows larger. By contrast, the period decreases as the difference grows smaller. Therefore, according to the first embodiment, the running-in operation can be prevented from being performed for a wasteful amount of time because the period time is determined based on the difference.

Specifically, the toner controller 20*c* controls formation of an electrostatic latent image on the photosensitive drum 101 of the image forming section 11*c* with a size corresponding to the amount CSc of cyan toner calculated by the first calculating section 20*b*. As a result, the cyan toner in the amount CSc is supplied from the corresponding developing section 110 to the photosensitive drum 101 after passing through the developing section 110 under triboelectric charging within the period. The toner controller 20*c* controls formation of an electrostatic latent image on the photosensitive drum 101 of the image forming section 11*m* with a size corresponding to the amount CSm of magenta toner calculated by the first calculating section 20*b*. As a result, the magenta toner in the amount CSm is supplied from the corresponding developing section 110 to the photosensitive drum 101 after passing through the developing section 110 under triboelectric charging within the period. The toner controller 20*c* controls formation of an electrostatic latent image on the photosensitive drum 101 of the image forming section 11*y* with a size corresponding to the amount CSy of yellow toner calculated by the first calculating section 20*b*. As a result, the yellow toner in the amount CSy is supplied from the corresponding developing section 110 to the photosensitive drum 101 after passing through the developing section 110 under triboelectric charging within the period. The toner controller 20*c* controls formation of an electrostatic latent image on the photosensitive drum 101 of the image forming section 11*k* with a size corresponding to the amount CSk of black toner calculated by the first calculating section 20*b*. As a result, the black toner in the amount CSk is supplied from the developing section 110 to the photosensitive drum 101 after passing through the developing section 110 under triboelectric charging within the period.

Therefore, according to the first embodiment, a color image can be formed on a sheet P with a high-precision image density because the amounts CSc, CSm, CSy, and CSk of the respective color toners are calculated.

The drive controller 20*d* controls the drive section 23 to rotationally drive the photosensitive drums 101, the development rollers 112, the first screw feeders 113, the second screw feeders 114, and the replenishment amount adjusting members 116*a*. For example, the drive controller 20*d* causes replenishment of toner in the amount calculated by the first calculating section 20*b* from a toner container 116 to a corresponding developing section 110 when toner in the amount calculated by the first calculating section 20*b* is supplied from the developing section 110 to a corresponding photosensitive drum 101.

Figure 5:
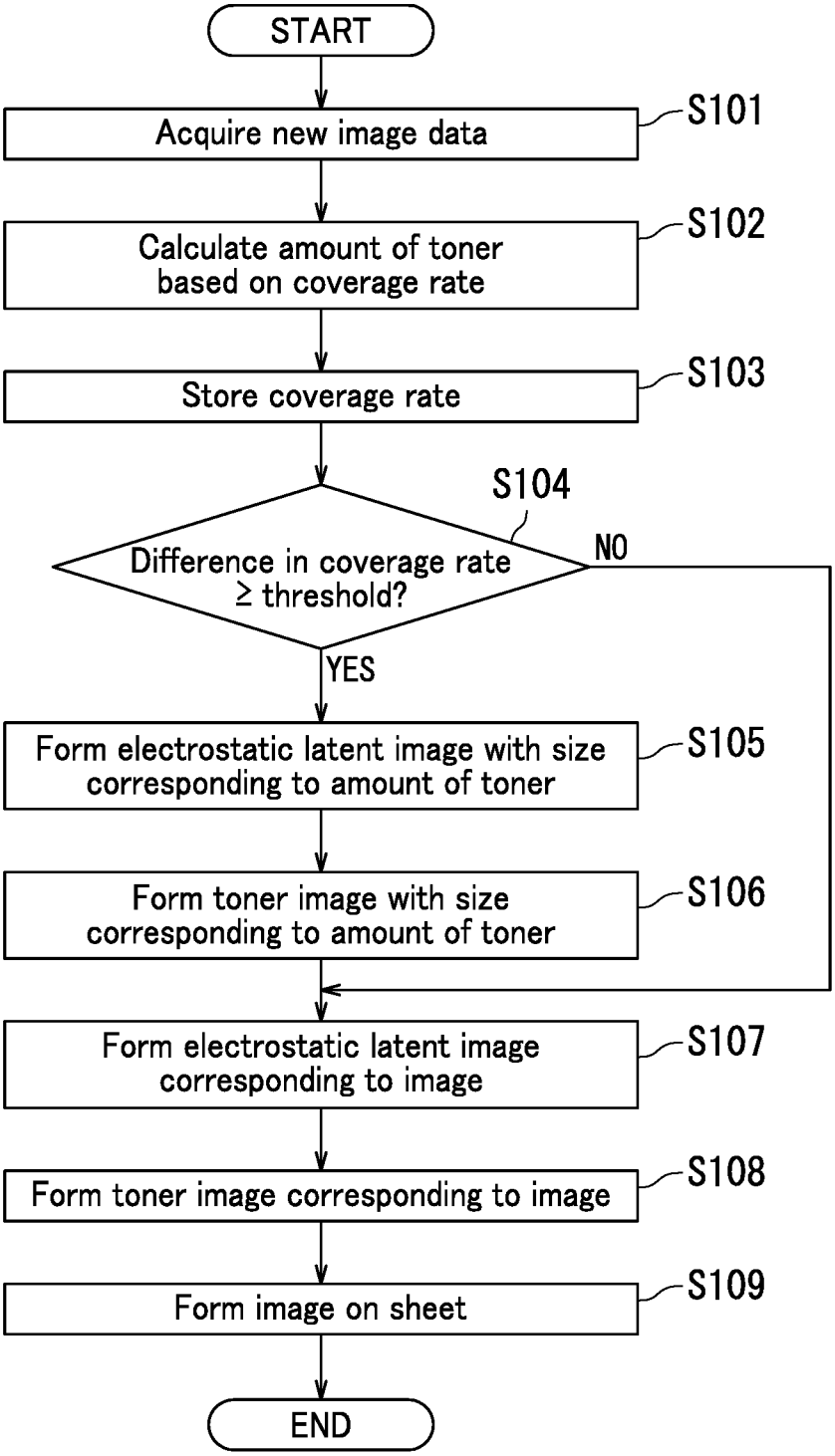
FIG. 5 is a flowchart depicting an example of a process performed by a controller according to the embodiment.

Next, an example of a process performed by the controller 20 according to the present embodiment is described with reference to FIG. 5. FIG. 5 is a flowchart depicting an example of the process performed by the controller 20. The process performed by the controller 20 according to the first embodiment includes Steps S101 to S109.

First, in Step S101, the acquiring section 20*a* acquires image data when a new print job is received. The process then advances to Step S102.

Next, in Step S102, the first calculating section 20*b* calculates an amount of toner to be supplied from a developing section 110 to a corresponding photosensitive drum 101 based on the coverage rate of a new image. The process then advances to Step S103.

Next, in Step S103, the first calculating section 20*b* stores the coverage rate of the new picture in the storage 80. The process then advances to Step S104.

Next, in Step S104, the determining section 20*e* determines whether or not the difference between the coverage rate of the new image and the coverage rate of a past image is equal to or greater than a threshold. When the determining section 20*e* determines that the difference is less than the threshold (NO in Step S104), the process advances to Step S107. When the determining section 20*e* determines that the difference is equal to or greater than the threshold by contrast (YES in Step S104), the process advances to Step S105.

Next, in Step S105, the toner controller 20*c* controls a corresponding exposure section 13 so as to form the electrostatic latent image GA with a size corresponding to the amount of toner calculated by the first calculating section 20*b*. The process then advances to Step S106.

Next, in Step S106, the toner controller 20*c* controls a corresponding image forming section 11 so as to supply toner in the amount calculated by the first calculating section 20*b* from the developing section 110 to the photosensitive drum 101, thereby forming a toner image. The process then advances to Step S107.

Next, in Step S107, the toner controller 20*c* controls the exposure section 13 so as to form the electrostatic latent image GA corresponding to the image. The process then advances to Step S108.

Next, in Step S108, the toner controller 20*c* controls the image forming section 11 so as to supply toner in the amount calculated by the first calculating section 20*b* from the developing section 110 to the photosensitive drum 101, thereby forming a toner image. The process then advances to Step S109.

Next, in Step S109, the controller 20 controls the image formation unit 10 to form an image on a sheet P, and the process ends.

Second Embodiment

The following describes an image forming apparatus 100 according to a second embodiment with reference to FIGS. 1 to 4. The second embodiment differs from the first embodiment in that an average value of the coverage rates of a plurality of new images is compared to an average value of the coverage rates of a plurality of past images.

The acquiring section 20*a* acquires image data of the past images formed on respective sheets. For example, the acquiring section 20*a* receives the image data from the scanner 91.

The determining section 20*e* compares the average value of the coverage rates of the new images to the average value of the coverage rates of the past images stored in the storage 80 to determine whether or not to perform the running-in operation. Specifically, images are formed on a plurality of sheets P when the difference between the average value of the coverage rates of the new images and the average value of the coverage rates of the past images is less than a threshold. By contrast, the running-in operation is performed when the difference between the average value of the coverage rates of the new images and the average value of the coverage rates of the past images is equal or greater than the threshold. It is preferable for the average value of the coverage rates of the past images to be an average value of the coverage rates of images calculated based on the coverage rates of a plurality of images formed on sheets from the latest to a prescribed number of sheets in the past. The prescribed number of sheets is preferably 30.

Therefore, according to the second embodiment, performance of the running-in operation can be prevented based on the coverage rate of a peculiar image.

Third Embodiment

The following describes an image forming apparatus 100 according to a third embodiment with reference to FIG. 4. The third embodiment differs from the first embodiment in that the toner charge amount is calculated.

As illustrated in FIG. 4, the controller 20 further includes a second calculating section 20*f*.

The second calculating section 20*f* calculates the toner charge amount after the toner controller 20*c* has performed the running-in operation and before an image is formed on a sheet P. Specifically, the second calculating section 20*f* causes formation of a patch image on a photosensitive drum 101 after the running-in operation has been performed and before an image is formed on a sheet P. The second calculating section 20*f* then calculates a charge amount of toner on the patch image based on the detection signal SG1 indicating the density of the patch image transferred from the photosensitive drum 101 to the intermediate transfer belt 12*a* and the detection signal SG2 indicating the electric current value of the electric current flowing between the photosensitive drum 101 and a corresponding development roller 112.

Therefore, according to the third embodiment, the toner charge amount when an image is formed on a sheet P and the toner charge amount directly before the image is formed on the sheet P can be equalized. As a result, an image with higher-precision image density can be formed on a sheet P using toner of which charge amount is equalized.

Embodiments of the present disclosure are described above with reference to the accompanying drawings. However, the present disclosure is not limited by the above embodiments and may be implemented in various manners within a scope not departing from the gist thereof. Furthermore, various disclosures may be created by appropriately combining elements of configuration disclosed in the above embodiments. For example, some of elements of configuration may be removed from the entirety thereof disclosed in the embodiments. Additionally, elements of configuration may be appropriately combined across different embodiments. The drawings illustrate main elements of configuration schematically to facilitate understanding thereof. Aspects of the elements of configuration such as thickness, length, number, and interval illustrated in the drawings may differ in practice for the sake of convenience for drawing preparation. Furthermore, aspects of the elements of configuration such as material, shape, and dimension described in the above embodiments are merely examples and not particular limitations. The elements of configuration may be variously altered within a scope not substantially departing from the effects of the present disclosure.

(1) As described with reference to FIGS. 1 to 5, the image forming apparatus 100 in the present embodiments is a color multifunction peripheral, but the present disclosure is not limited as such. The image forming apparatus need only form a toner image on a sheet P. The image forming apparatus may be a color printer, for example. Alternatively, the image forming apparatus may be a monochrome copier, for example.

(2) In the present embodiments, the toner controller 20*c* performs control so that an electrostatic latent image with a size corresponding to an amount of toner calculated by the first calculating section 20*b* is formed on a photosensitive drum 101 and toner is supplied in the amount calculated by the first calculating section 20*b* from a corresponding developing section 110 to the photosensitive drum 101, but the present disclosure is not limited as such. The toner controller 20*c* may perform control so that an electrostatic latent image is formed on the photosensitive drum 101 at a potential VL corresponding to the amount of toner calculated by the first calculating section 20*b* and toner is supplied in the amount calculated by the first calculating section 20*b* from the developing section 110 to the photosensitive drum 101. In detail, the toner controller 20*c* controls the exposure section 13 so as to irradiate laser light at a prescribed strength or prescribed light quantity.

What is claimed is:

1. An image forming apparatus comprising:

an image forming section configured to form an image on a sheet;

a controller configured to control the image forming section; and storage, wherein the image forming section includes:

a photosensitive drum on which an electrostatic latent image corresponding to the image is formed; and a developing section which develops the electrostatic latent image with toner, the storage stores therein a coverage rate of a past image specified by a past print job, the controller includes:

a determining section which, when a new print job is received, determines whether or not to perform a running-in operation by comparing a coverage rate of a new image specified by the new print job to the coverage rate of the past image stored in the storage; and a first calculating section which calculates an amount of toner to be supplied from the developing section to the photosensitive drum based on the coverage rate of the new image, and the running-in operation is to supply the toner in the amount calculated by the first calculating section from the developing section to the photosensitive drum before the new image is formed on the sheet.

2. The image forming apparatus according to claim 1, wherein the determining section determines a period for which the running-in operation is performed based on a difference between the coverage rate of the new image and the coverage rate of the past image.

3. The image forming apparatus according to claim 1, wherein the coverage rate of the past image includes a coverage rate of another image formed on another sheet directly before the image is formed on the sheet according to the new print job.

4. The image forming apparatus according to claim 1, wherein the controller further includes an acquiring section which acquires image data of the new image, and the first calculating section calculates the coverage rate of the new image based on the image data.

5. The image forming apparatus according to claim 4, wherein the acquiring section acquires image data of a plurality of new images to be formed on respective sheets, the first calculating section calculates an average value of coverage rates of the new images based on the image data, and the determining section compares the average value of the coverage rates of the new images to an average value of coverage rates of a plurality of past images stored in the storage.

6. The image forming apparatus according to claim 4, wherein the image forming section is provided as a plurality of image forming sections, the image forming sections develop respective electrostatic latent images, the electrostatic latent images are developed with respective different colored toners, the image data includes information indicating a color image in which images of respective different colors are superimposed, and the first calculating section calculates an amount of each of the colored toners based on a coverage rate of a corresponding one of the images of the respective different colors.

7. The image forming apparatus according to claim 1, wherein the developing section includes a conveyance section which houses the toner and a carrier, and the toner is triboelectrically charged through friction with the carrier while moving within the conveyance section.

8. The image forming apparatus according to claim 7, wherein the controller further includes a second calculating section which calculates a charge amount of the toner after the running-in operation has been performed and before the image is formed on the sheet.

9. The image forming apparatus according to claim 1, wherein the electrostatic latent image with a size corresponding to the amount of the toner calculated by the first calculating section is formed on the photosensitive drum, and the controller further includes a toner controller which controls the image forming section so as to supply the toner in the calculated amount from the developing section to the photosensitive drum.

* * * * *